US005918419A

United States Patent [19]

Cangialosi et al.

[11] Patent Number: 5,918,419

[45] Date of Patent: Jul. 6, 1999

[54] PARTING RAIL RELEASE MECHANISM

[75] Inventors: Ignazio Cangialosi, Franklin Lakes; Jay F. Halsey, Mount Arlington; Gregory B. Shaffer, Wayne, all of N.J.

[73] Assignee: Vinyl Building Products, Inc., Oakland, N.J.

[21] Appl. No.: 08/833,668

[22] Filed: Apr. 8, 1997

[51] Int. Cl.[6] ..... E05D 15/22

[52] U.S. Cl. ..... 49/194; 49/414

[58] Field of Search ..... 49/176, 181, 194, 49/414, 415, 416, 453, 454, 455, 456, 457

[56] References Cited

U.S. PATENT DOCUMENTS

| | | | |
|---|---|---|---|
| 2,747,241 | 5/1956 | Marousky | 49/194 X |
| 2,865,061 | 12/1958 | Kunkel | 49/194 X |
| 4,283,883 | 8/1981 | Sterner | 49/194 |
| 5,566,507 | 10/1996 | Schmidt et al. | 49/181 X |

*Primary Examiner*—Jerry Redman
*Attorney, Agent, or Firm*—Richard R Muccino

[57] ABSTRACT

The present invention is directed to a window assembly comprising (a) a frame having opposed, vertical jambs with an upper sash guide rail, joined at their ends to the ends of opposed, horizontal top and bottom members forming, respectively, a header and a sill; (b) an upper and lower window sash, with the upper sash having stiles extending into the guide rails in the jamb to enable vertical sliding movement of the upper sash in the frame; (c) a parting rail mounted to the upper portion of each jamb in a channel adjacent to the upper sash guide rail to retain the upper sash within the frame, each parting rail having a longitudinal dimension about equal to the longitudinal dimension of the upper sash; (d) a parting rail spring means mounted in each channel to push the parting rail away from the jamb and towards the sash to hold the upper sash in place; and (e) a parting rail activator mounted on the upper outer edge of each upper sash; wherein the parting rail activator engages the parting rail when the upper sash is pulled down thereby pushing the parting rail into the channel to allow the upper sash to be tilted inward. The present invention is directed to a single-hung and double-hung window assemblies comprising the novel parting rail and parting rail activator.

12 Claims, 3 Drawing Sheets

PARTING RAIL RELEASE MECHANISM

FIELD OF THE INVENTION

The present invention is directed to a window assembly comprising (a) a frame having opposed, vertical jambs with an upper sash guide rail, joined at their ends to the ends of opposed, horizontal top and bottom members forming, respectively, a header and a sill; (b) an upper and lower window sash, with the upper sash having stiles extending into the guide rails in the jamb to enable vertical sliding movement of the upper sash in the frame; (c) a parting rail mounted to the upper portion of each jamb in a channel adjacent to the upper sash guide rail to retain the upper sash within the frame, each parting rail having a longitudinal dimension about equal to the longitudinal dimension of the upper sash; (d) a parting rail spring means mounted in each channel to push the parting rail away from the jamb and towards the sash to hold the upper sash in place; and (e) a parting rail activator mounted on the upper outer edge of each upper sash; wherein the parting rail activator engages the parting rail when the upper sash is pulled down thereby pushing the parting rail into the channel to allow the upper sash to be tilted inward. The present invention is directed to a single-hung and double-hung window assemblies comprising the novel parting rail and parting rail activator.

DESCRIPTION OF THE BACKGROUND

Conventional double-hung window assemblies consist of a perimeter window frame and two window sashes. The window frame contains two opposed, vertical members called jambs which contain upper and lower guide rails in which the window sashes move. The window frame also contains two opposed, horizontal top and bottom members forming, respectively, a header and a sill. Each window sash has a top and bottom rail and a pair of vertical side members called stiles. The stiles extend into the guide rails in the jamb to enable the sashes to slide within the frame. A double hung window consists of two sashes, one above the other, both of which slide vertically. A single hung window utilizes a fixed sash in conjunction with a slidable sash.

Recently, such window assemblies and sashes have been prefabricated from extruded synthetic plastic. These double-hung window assemblies generally provide for inward tilting or pivoting of the two sashes by means of rotating members at the bottom ends of the sash balance mechanisms. Normal vertical reciprocal movement of the sashes is maintained by latch mechanisms disposed at the top margins of the sashes. The latch mechanisms usually include some manner of latch bolts that can slide along guide rails extending vertically of the master frame jambs. Releasing the latch mechanisms permits the sash to be pivoted inwardly for cleaning or servicing of the window glass pane.

It is inherent in the type of window construction containing pivoting sashes that the perimeter frame does not include a fixed channel which receives the vertical stiles of the sash when in its closed position. That is, if the sash is to be removed by tilting, the conventional frame cannot form a fixed vertical flange or web which overlies those surfaces of the sash side rails which face inwardly toward the interior of the building. The result is that there is considerable leakage of air past the sash even though weather stripping is usually provided between the laterally facing surfaces of the side rails and the frame and between the outwardly facing surfaces of the side rails and the frame. Thus there is no weather stripping along the inner faces of the sash side rails, and in addition the lack of support for these faces may permit the sash to bow slightly toward the interior of the building under the influence of wind, thereby decreasing the effectiveness of the existing weather stripping.

U.S. Pat. No. 1,928,262 (J. A. Nyberg) discloses a window sash securing construction for mounting sashes in an airtight manner without the use of ropes, pulleys or weights. As shown in FIGS. 2–4, the securing construction is a window holder comprising a lever 35 attached to an angle plate 36. Coil springs 44 provide the tension to secure the window. As shown in FIG. 7, when latch 47 is pressed into the window frame, spring 44 causes the latch to engage inner wall 59 maintaining airtight connection between the sash and the frame.

U.S. Pat. No. 2,604,676 (A. Kalla, Jr.) discloses an auxiliary storm window assembly in which the sashes may be mounted and removed within the outer margin of a standard window frame, see FIGS. 1 and 3. The auxiliary window frame has stiles with longitudinal grooves, a slidable elongated shoe mounted in each of the grooves, and a sash between the shoes. Each shoe has a channel perpendicular to the sash with a bridge across the lower end of the channel. Each sash has a lug which extends down into the channel into the shoe and interlocks with the bridge to connect the lower end of the shoe to the lower end of the sash. A lug on the upper end of the shoe extends inward at the upper end of the sash. Sliding latches on the upper end of the sash interlock with the lug for holding the upper end of the sash. As shown in FIG. 10, the storm sashes may be removed from the frame by sliding latches 34 inwardly away from lugs 52 on adjacent plates 44.

U.S. Pat. No. 3,194,194 (D'Arcy A. Young, Jr.) discloses a sash balance for counterbalancing the weight of a removable sash and a locking device for the sash in a window frame, as shown in FIG. 1. The sash balance and locking device comprise a locking block having a slot and a slidable flexible portion along a guideway, a sash connector in the slot connected to the sash balance, and a latch on the sash to engage the locking block and the sash connector. A cam on the sash connector is provided for bearing against the locking block and causing the flexible portion of the block to engage the guideway to remove the latch. As set out in FIGS. 1 and 2, a number of conical springs 35 are provided in hollow groove 36 of covering 10. The conical springs 35 force guide 14 against sash 11. To remove sash 11 from window frame 10, sash 11 is moved horizontally in one direction causing guide 14 to compress springs 35 moving guide 14 into grove 36. This horizontal movement allows the opposite side of sash 11 to be freed from guide 14 on the opposite side of the window.

U.S. Pat. No. 3,499,248 (H. Baer) discloses a prefabricated prime window and frame structure which may be of plastic construction having removable sash-balanced window panels. The prefabricated window frame structure comprises a unitized frame structure having a sash balance and a clutch mechanism to remove the panels. As set out in FIG. 2, the sash balance comprises a suspended spring tension and a panel suspension arm for movement lengthwise and adjacent to the guide tracks. The panel suspension arm is inserted in a tubular side opening in the window panel to transfer spring tension for counterbalancing the window panel during movements between raised and lowered positions. The clutch mechanism comprises a releasable lock for the panel suspension arm to retain the position of the panel arm when the window panel is removed from assembly. The clutch mechanism includes a pivotally mounted rocker arm having a clutch releasing end and a pivotally opposite wedging end. The clutch mechanism includes a spring for pivoting the wedging end into contact with the guide track when the window panel is disengaged from the panel suspension arm. The clutch releasing end is engageable with an edge of the window panel to pivot the wedging end out of contact with the guide track when the window panel is engaged with the panel suspension arm to accommodate raising and lowering movements of the window panel.

U.S. Pat. No. 4,262,449 (Riegelman et al.) discloses a hung aluminum window and a takeout mechanism in which the sash has plastic inserts in its stiles at the upper and lower ends to serve as guides and spacers which bear against the jambs of the frame in which the stiles are positioned. The plastic insert has a portion located between the stile and the adjacent jamb to form a spacer preventing metal to metal contact between the jamb and stile. Each plastic insert has a housing portion and a button located extending through one wall. A compression spring is located in each housing portion and extends between the button and the opposing wall. The stiles have openings aligned with the buttons of the housing portions. The springs normally bias the buttons so they extend through the stile openings. The extended buttons interfere with the adjacent jambs to prevent lateral movement of the sash for takeout purposes. Elongated stops are located in the head of the frame which may be swiveled between vertical and horizontal positions, and when in a vertical position prevent upward movement of the sash beyond the point where it is not engaged by the feet of the balance mechanisms mounted in the jambs. To remove the sash from the frame, the stop members are moved to horizontal positions to permit the sash to be moved upward sufficiently so that its lower end clears the feet of the balance mechanisms. The feet are captured by clips secured in the jambs. When the sash is disengaged from the balance mechanisms, it can be removed by depressing the pushbuttons of one stile to clear the adjacent jamb wall as the sash is moved laterally into the jamb and the opposite stile clears the opposite jamb and can be swung free to permit the sash to be pulled free of the frame.

U.S. Pat. No. 4,283,883 (Sterner, Jr. et al.) discloses a storm window assembly wherein the lower sash is mounted with a vertical movable sash retainer 72 which improves air tightness, see FIG. 3. The storm window assembly has a removable sash fitted into a frame formed by longitudinal members joined at their ends to the ends of transverse members. The sashes have a mounting piece for sliding movement in the frame in a longitudinal direction between a closed position and an open position and for inward movement. The improvement comprises a sash retainer 72 mounted on each longitudinal frame member for longitudinal sliding movement relative to the respective frame member. Each retainer has a longitudinal dimension about equal to the longitudinal dimensions of the slidable sash and is slidable between a first position coextensive with the slidable sash and a second position in which the retainer is longitudinally offset from the slidable sash. Each retainer has a longitudinal fin overlying the surface of the longitudinal edge of the slidable sash when the sash and the retainer are coextensive to thereby provide support and sealing the surface. Manually releasable latches for connecting the slidable sash to the retainers are also included.

U.S. Pat. No. 4,622,778 (Simpson) discloses a pivotal window sash of a double-hung window assembly having a framing formed of extruded plastic material providing a hollow formation extending throughout and opening to the ends. The window includes a latch in the corner box or butt joints of the sash. The latch has a latch bolt extending beyond the stile and engagable with one of the guide rails. As shown in FIGS. 2–4, latch bolt 112 is molded of plastic material and is longitudinally slidable in channel 118 with screw post 93 acting as a stop. Wire wound compression type springs 114 are mounted between the latch bolt 112 and platform 94 and maintain bolt 112 in its extended position. Reciprocal movement of thumb slide actuator button 116 causes a reciprocal movement of bolt 112 for retracting the bolt from engagement with the frame jamb.

U.S. Pat. No. 4,726,148 (Tix) discloses a channel-shaped bracket of polyvinyl chloride having a dual durometer value having leg portions and hook portions integral with the free edges of the leg portions. The jamb liner is also of polyvinyl chloride. The hook portions, softer and more flexible than the ridge hooks, readily release the jamb liner when a sufficient pull is applied so that the liner can be easily removed from the wooden jamb to which it is attached. As shown in FIGS. 2 and 5, bracket 50 is comprised of web 52, web extensions 54, leg portions 56, and hook portions 58. The hook portions 58 engage the ridge hooks 46. Channel-shaped bracket 50 is formed with hook portions 58 that are softer and more flexible than the remainder of the bracket 50.

U.S. Pat. No. 4,993,188 (Erickson et al.) discloses a single hung window jambliner, a resilient, flexible material layer secured to the jambliner, and a resilient compressible pad secured between the material layer and the jamb to prevent airflow between the jamb pocket and the jamb. The jambliner is mounted in the jamb pockets of a window frame and comprises an elongated channel having a base portion, a pair of opposite longitudinal sides, and a pair of resilient leg portions for receiving the sash. The resilient, flexible material layer secured to the jambliner protrudes beyond the sides. The resiliently compressible pad secured between the material layer and the jamb fills the depth of the pocket and biases the material layer against the jamb lips to form a seal to prevent air movement. As shown in FIGS. 3–5, jambliner 78 is generally in the shape of a rectangular channel having a base 80, opposing vertical sides 82 and 84, and a pair of outwardly angularly projecting legs 86 and 88 extending from sides 82 and 84. FIG. 3 shows a broken line configuration of legs 86 and 88 indicating the resiliency of the legs to allow for pivoting of the sash out of the jamb liner, as well as allow sliding motion in moving the sash upwardly or downwardly along the jambliner 78. The pocket formed within jambliner 78 houses the mechanical balance assembly 91 which assists in raising the sash.

U.S. Pat. No. 5,119,592 (Westfall et al.) discloses a counterbalance mechanism for a vertically movable sash having components extending downward within guides that resiliently engage a vertical groove in a side of the sash and allow the sash to be tilted and removed from the window. The counterbalance system comprises (a) a counterbalance device mounted in the window in a position within the guide where the counterbalance device is surrounded and enclosed by the guide and where the mounting of the counterbalance device is arranged to allow a vertical mid-region of the guide to move laterally out of the sash groove, so that the sash can tilt from the vertical plane; (b) at least a lower region of the guide having a divided wall confronting the sash groove; (c) an interconnector extending between the sash and a lower region of the counterbalance device being arranged to pass through the divided wall for moving vertically with the sash; (d) a resilient support being joined to the guide and to the window, for mounting the guide in a vertical position within the window, and for biasing the guide resiliently against the sash; and (e) an upper region of the guide and an upper region of the counterbalance device each being fixed in place in the window against both vertical and lateral movement, and the guide and the counterbalance device being laterally movable in the mid-region below the upper region.

The double hung window assembly having pivotal sashes of the present invention overcomes the above summarized disadvantages by means of an improved sash constructed from extruded plastic framing members having a novel parting rail, mounted to the upper portion of each jamb, to retain the upper sash within the frame and a novel parting rail activator, mounted on the upper outer edge of each upper sash, so that the parting rail activator engages the parting rail when the upper sash is pulled down thereby pushing the parting rail into a T-shaped channel to allow the upper sash to be tilted inward. Pivot pins for the sash are not required.

IN THE FIGURES

Figure 3:
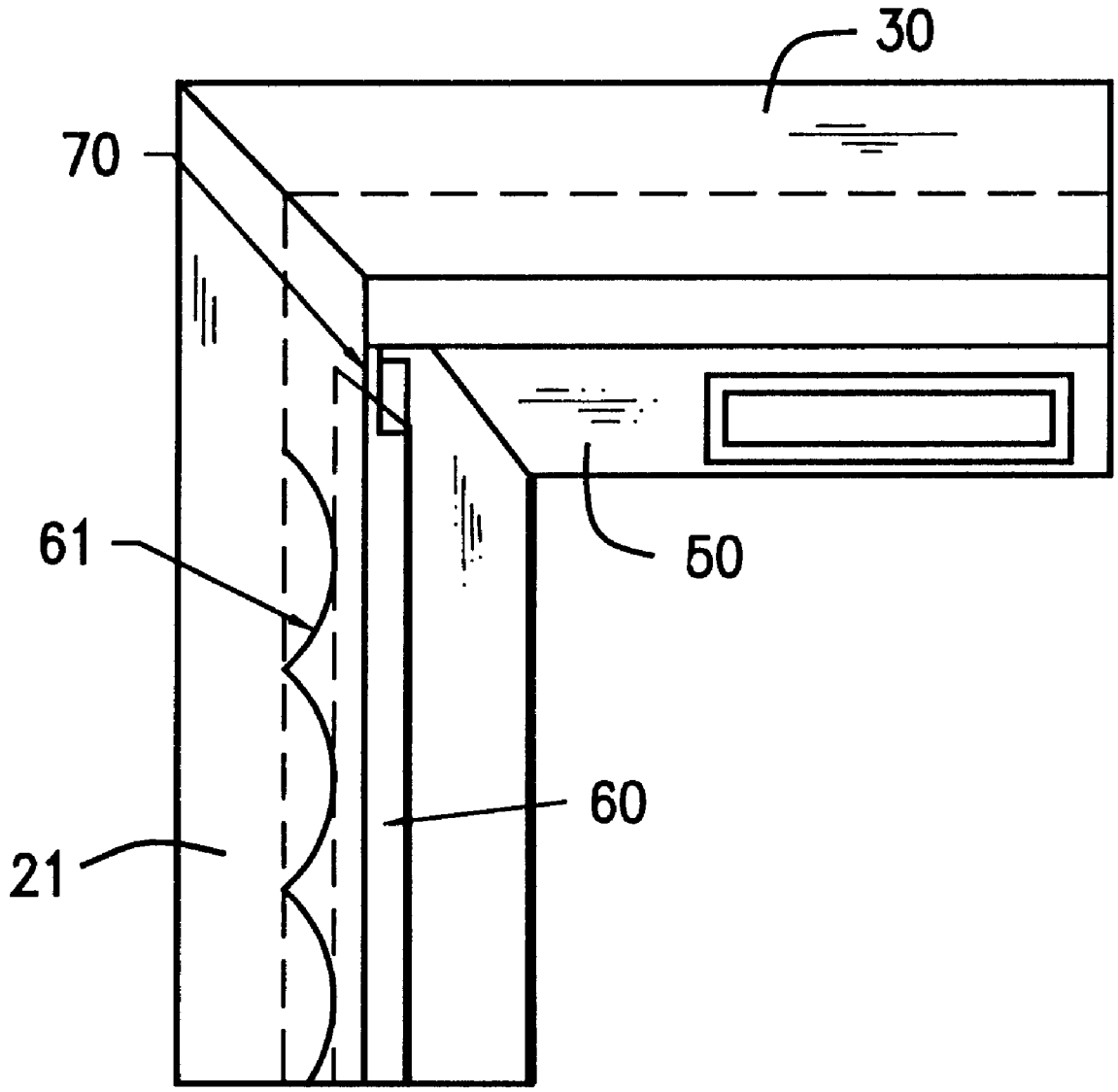

FIG. 3 is a sectional view of a double-hung window assembly of the present invention showing a parting rail mounted to the upper portion of the jamb in a T-shaped channel, a parting rail spring means mounted in the T-shaped channel to push the parting rail away from the jamb and towards the sash, and a parting rail activator mounted on the upper outer edge of the upper sash to engage the parting rail when the upper sash is pulled down.

SUMMARY OF THE INVENTION

The present invention is directed to a window assembly comprising:

(a) a frame having opposed, vertical jambs with an upper sash guide rail, joined at their ends to the ends of opposed, horizontal top and bottom members forming, respectively, a header and a sill;

(b) an upper and lower window sash, with the upper sash having stiles extending into the guide rails in the jamb to enable vertical sliding movement of the upper sash in the frame;

(c) a parting rail mounted to the upper portion of each jamb in a channel adjacent to the upper sash guide rail to retain the upper sash within the frame, each parting rail having a longitudinal dimension about equal to the longitudinal dimension of the upper sash;

(d) a parting rail spring means mounted in each channel to push the parting rail away from the jamb and towards the sash to hold the upper sash in place; and (e) a parting rail activator mounted on the upper outer edge of each upper sash;

wherein the parting rail activator engages the parting rail when the upper sash is pulled down thereby pushing the parting rail into the channel to allow the upper sash to be tilted inward.

In another embodiment, the present invention is directed to a double-hung window assembly comprising:

(a) a frame having opposed, vertical jambs with upper and lower sash guide rails, joined at their ends to the ends of opposed, horizontal top and bottom members forming, respectively, a header and a sill;

(b) an upper and lower window sash each with stiles extending into their respective guide rails in the jamb to enable vertical sliding movement of the sashes in the frame;

(c) a parting rail mounted to the upper portion of each jamb in a channel between the upper and lower sash guide rails to retain the upper sash within the frame, each parting rail having a longitudinal dimension about equal to the longitudinal dimension of the upper sash;

(d) a parting rail spring means mounted in each channel to push the parting rail away from the jamb and towards the sash to hold the upper sash in place; and (e) a parting rail activator mounted on the upper outer edge of each upper sash;

wherein the parting rail activator engages the parting rail when the upper sash is pulled down thereby pushing the parting rail into the channel to allow the upper sash to be tilted inward.

DETAILED DESCRIPTION OF THE INVENTION

The present invention is directed to a novel window assembly, preferably a double-hung window assembly, containing a parting rail mounted to the upper portion of the jamb in a channel, preferably a T-shaped channel, between the upper and lower sash guide rails to retain the upper sash within the frame. The parting rail is a rail that keeps the upper sash in place and must be pushed into the side of the jamb so that the upper sash can be tilted inward for cleaning. The parting rail activator (parting rail release mechanism, parting stop activator) of the invention is located on the upper outer edge of the upper sash so that when the upper sash is pulled down, the parting rail activator engages the parting rail, which may be beveled, pushing the parting rail into the jamb and allowing the upper sash to be tilted inward. Parting rail spring means are mounted in the T-shaped channel keeping outward pressure on the parting rail to push the parting rail away from the jamb and towards the sash to hold the upper sash in place. When the upper sash is pulled upward again, the parting rail spring means push the parting rail out of the jamb to hold the upper sash in place. The double-hung window assembly is preferably a plastic assembly. The present invention is also directed to a single-hung window assembly comprising the novel parting rail and parting rail activator.

The novel window assembly of the present invention employing the parting rail and the parting rail activator can be better understood by reference to the Figures in which similar parts are identified with the same reference numerals throughout the Figures. Although the present invention is described and illustrated in connection with preferred embodiments, applicant intends that modifications and variations may be used without departing from the spirit of the present invention.

Figure 1:
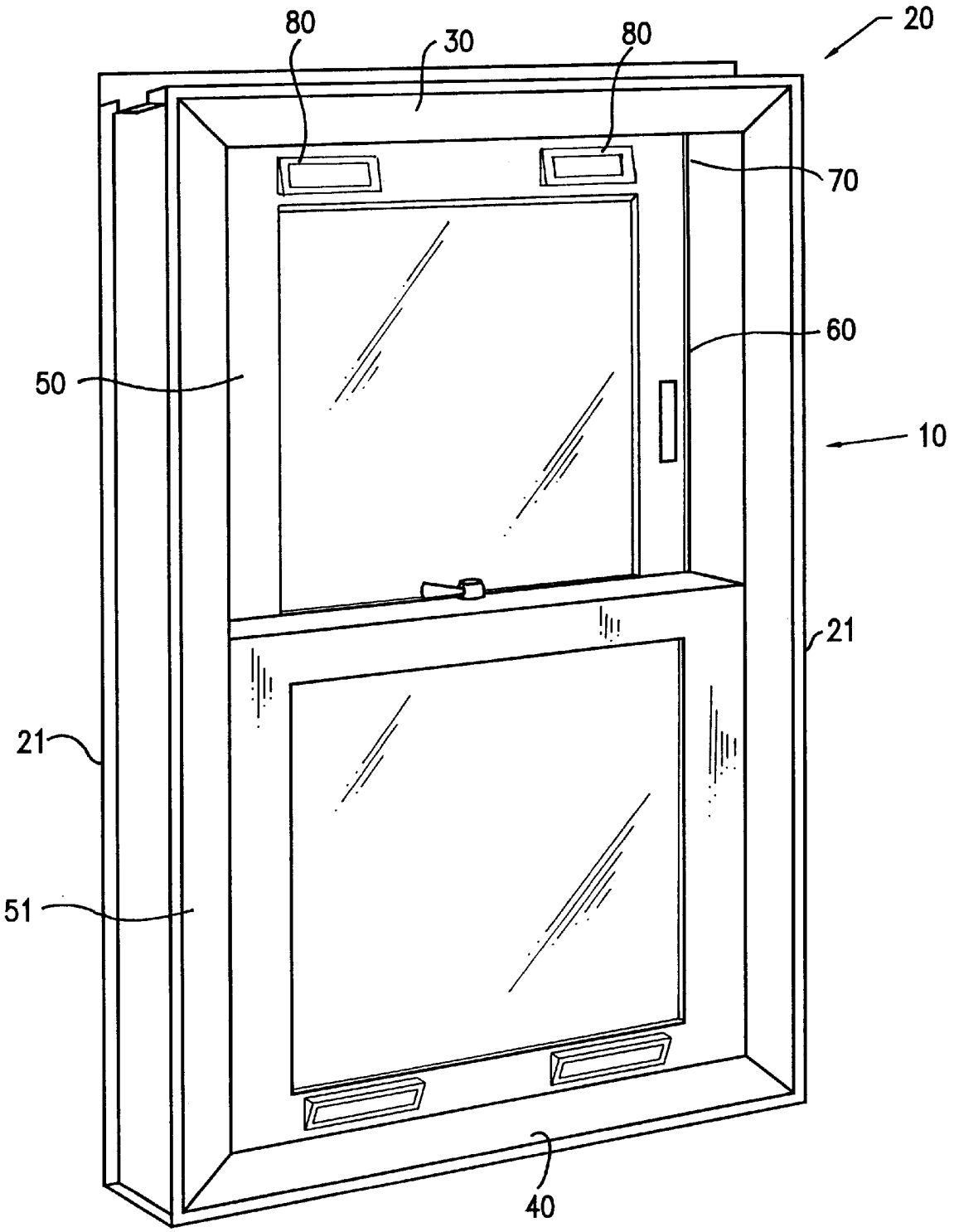
FIG. 1 is a cutaway view of a double-hung window assembly of the present invention showing a parting rail mounted to the upper portion of the jamb and a parting rail activator mounted on the upper outer edge of the upper sash.
Figure 2:
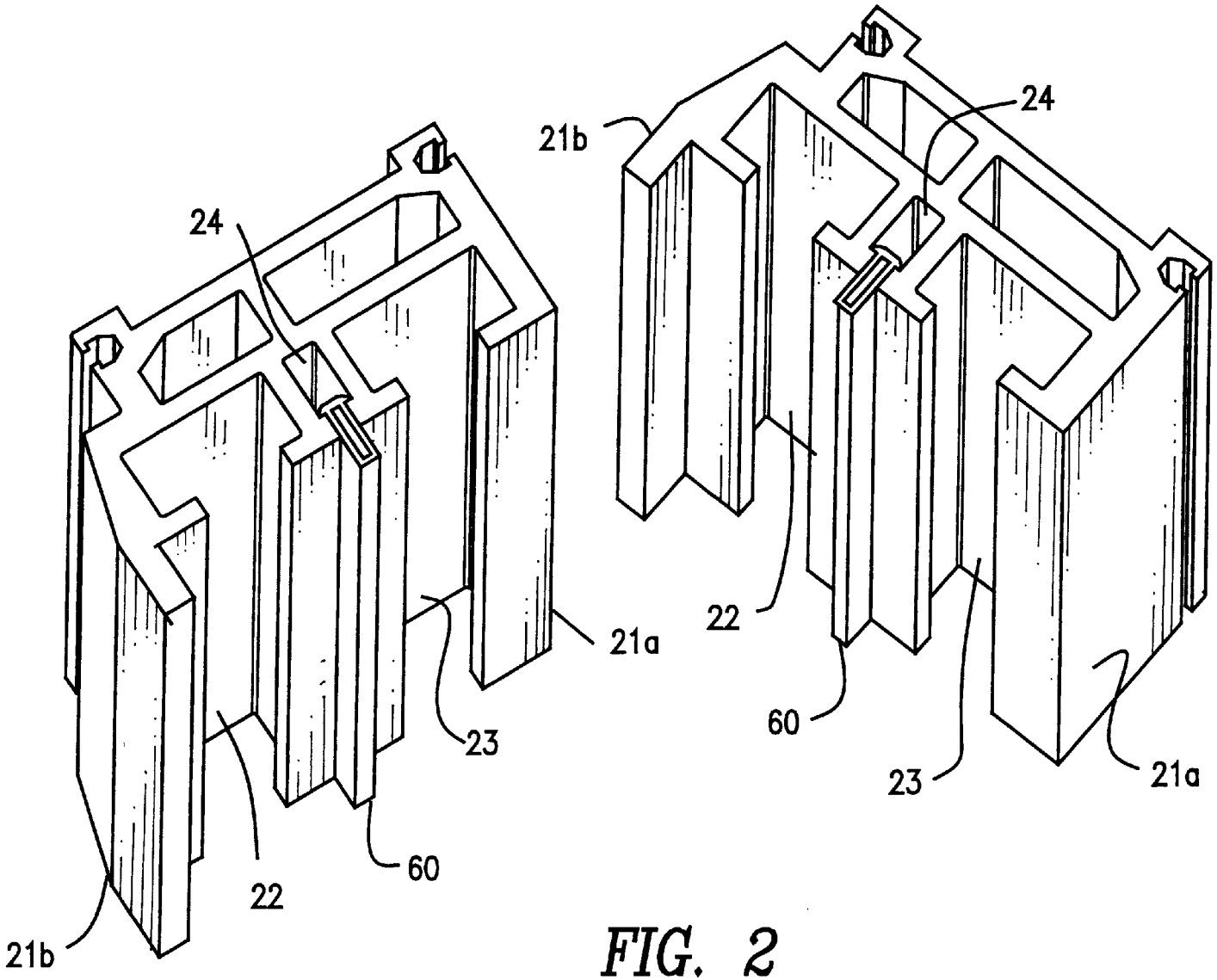
FIG. 2 is a cutaway view of a double-hung window assembly of the present invention showing a cross-section of a vertical jamb with upper and lower sash guide rails and a parting rail mounted to the jamb in a T-shaped channel between the upper and lower sash guide rails.

FIG. 1 is a cutaway view of a double-hung window assembly of the present invention showing a parting rail mounted to the upper portion of the jamb and a parting rail activator mounted on the upper outer edge of the upper sash. FIG. 2 is a cutaway view of a double-hung window assembly of the present invention showing a cross-section of a vertical jamb with upper and lower sash guide rails and a parting rail mounted to the jamb in a T-shaped channel between the upper and lower sash guide rails. FIG. 3 is a sectional view of a double-hung window assembly of the present invention showing a parting rail mounted to the upper portion of the jamb in a T-shaped channel, a parting rail spring means mounted in the T-shaped channel to push the parting rail away from the jamb and towards the sash, and a parting rail activator mounted on the upper outer edge of the upper sash to engage the parting rail when the upper sash is pulled down.

Referring to FIG. 1, double-hung window assembly of the present invention is designated generally as 10. As shown in FIGS. 1–3, double-hung window assembly 10 contains a frame 20 having opposed, vertical jambs 21. Jambs 21 contain upper sash guide rail 22 and lower sash guide rail 23 (FIG. 2). Jamb 21*a* is on the inside of the window assembly and jamb 21*b* is on the outside of the window assembly. Joined to the ends of the jambs are opposed, horizontal top and bottom members forming, respectively, header 30 and sill 40. Upper window sash 50 and lower window sash 51 each with stiles (not shown) extend into their respective guide rails, 22 and 23, in jamb 21 to enable vertical sliding movement of the sashes in frame 20. Parting rail 60 is mounted to the upper portion of jamb 21 in T-shaped channel 24 between the upper sash guide rail 22 and lower sash guide rail 23 to retain upper sash 50 within frame 20. Each parting rail 60 has a longitudinal dimension about equal to the longitudinal dimension of upper sash 50. A parting rail spring means 61, such as a compression spring, is mounted in T-shaped channel 24 to push parting rail 60 away from jamb 21 and towards sash 50 to hold the upper sash 50 in place. A parting rail activator 70 is mounted on the upper outer edge of upper sash 50. When upper sash 50 is pulled down, the parting rail activator 70 engages the parting rail 60 thereby pushing the parting rail 60, which may be beveled, into T-shaped channel 24 to allow the upper sash 50 to be tilted inward.

Optionally, a stationery parting rail may be mounted in header 30 (not shown) to further retain upper sash 50 within frame 20. A push handle 80 may also be included in the upper rail of upper sash 50 to faciliate pushing the upper sash down.

The present invention is also directed to a single-hung window assembly comprising the novel parting rail and parting rail activator.

The invention being thus described, it will be obvious that the same may be varied in many ways. Such variations are not to be regarded as a departure from the spirit and scope of the invention and all such modifications are intended to be included within the scope of the following claims.

We claim:

1. A window assembly comprising:

(a) a frame having opposed, vertical jambs with an upper sash guide rail, joined at their ends to ends of opposed, horizontal top and bottom members forming, respectively, a header and a sill;

(b) an upper and lower window sash, with the upper sash having stiles extending into the guide rails in the vertical jambs to enable vertical sliding movement of the upper sash in the frame;

(c) a parting rail mounted to an upper portion of each jamb in a channel adjacent to the upper sash guide rail to retain the upper sash within the frame, each parting rail having a longitudinal dimension about equal to the longitudinal dimension of the upper sash;

(d) a parting rail spring means mounted in each channel to push the parting rail away from the vertical jambs and towards the sash to hold the upper sash in place; and (e) a parting rail activator mounted on the upper outer edge of each upper sash;

wherein the parting rail activator engages the parting rail when the upper sash is pulled down thereby pushing the parting rail into the channel to allow the upper sash to be tilted inward.

2. The window assembly according to claim 1, wherein the parting rail is beveled.

3. The window assembly according to claim 1, wherein the parting rail spring means is a compression spring.

4. The window assembly according to claim 1, further comprising a stationery parting rail mounted in the header to further retain the upper sash within frame.

5. The window assembly according to claim 1, further comprising a push handle in the upper sash.

6. The window assembly according to claim 1, wherein the channel is a T-shaped channel.

7. A double-hung window assembly comprising:

(a) a frame having opposed, vertical jambs with upper and lower sash guide rails, joined at their ends to ends of opposed, horizontal top and bottom members forming, respectively, a header and a sill;

(b) an upper and lower window sash each with stiles extending into their respective guide rails in the vertical jambs to enable vertical sliding movement of the sashes in the frame;

(c) a parting rail mounted to an upper portion of each jamb in a channel between the upper and lower sash guide rails to retain the upper sash within the frame, each parting rail having a longitudinal dimension about equal to the longitudinal dimension of the upper sash;

(d) a parting rail spring means mounted in each channel to push the parting rail away from the vertical jambs and towards the sash to hold the upper sash in place; and (e) a parting rail activator mounted on the upper outer edge of each upper sash;

wherein the parting rail activator engages the parting rail when the upper sash is pulled down thereby pushing the parting rail into the channel to allow the upper sash to be tilted inward.

8. The double-hung window assembly according to claim 7, wherein the parting rail is beveled.

9. The double-hung window assembly according to claim 7, wherein the parting rail spring means is a compression spring.

10. The double-hung window assembly according to claim 7, further comprising a stationery parting rail mounted in the header to further retain the upper sash within frame.

11. The double-hung window assembly according to claim 7, further comprising a push handle in the upper sash.

12. The double-hung window assembly according to claim 7, wherein the channel is a T-shaped channel.

* * * * *